United States Patent [19]

Lakic

[11] Patent Number: 4,941,271

[45] Date of Patent: Jul. 17, 1990

[54] BOOT WITH FRICTIONAL HEAT GENERATOR AND FORCED AIR CIRCULATION

[76] Inventor: Nikola Lakic, 45-191 Elm St., Indio, Calif. 92201

[21] Appl. No.: 230,908

[22] Filed: Aug. 11, 1988

[51] Int. Cl.[5] ..... A43B 7/02; A43B 5/04; A41D 1/00; A61F 7/00

[52] U.S. Cl. ..... 36/2.6; 36/117; 36/119; 2/2.1 R

[58] Field of Search ..... 36/2.6, 3 R, 3 B, 71, 36/93, 119, 28, 27, 117; 126/206, 204; 219/211, 527; 2/2.1 R

[56] References Cited

U.S. PATENT DOCUMENTS

| | | | |
|---|---|---|---|
| 3,029,530 | 4/1962 | Eaton | 36/3 R |
| 3,892,225 | 7/1975 | Twose | 2/2.1 R |
| 4,420,893 | 12/1983 | Stephan | 36/3 R |
| 4,507,877 | 4/1985 | Vaccari et al. | 36/2.6 |
| 4,547,906 | 10/1985 | Nishida et al. | 36/2.6 X |
| 4,631,843 | 12/1986 | Annovi | 36/119 |
| 4,702,022 | 10/1987 | Porcher | 36/93 |
| 4,756,095 | 7/1988 | Lakic | 36/2.6 |
| 4,782,602 | 11/1988 | Lakic | 36/2.6 |
| 4,799,319 | 1/1989 | Zellweger | 36/2.6 |
| 4,800,867 | 1/1989 | Owens | 36/2.6 X |
| 4,823,482 | 4/1989 | Lakic | 36/2.6 |
| 4,845,338 | 7/1989 | Lakic | 219/211 |

FOREIGN PATENT DOCUMENTS

| | | | |
|---|---|---|---|
| 2321817 | 11/1973 | Fed. Rep. of Germany | 36/3 R |

*Primary Examiner*—James Kee Chi

*Attorney, Agent, or Firm*—Plante Strauss Vanderburgh

[57] ABSTRACT

There is disclosed a frictional heat generator and a forced air circulation system for shoes and, in particular, for boots such as ski boots. The shoe has an inner sole which is formed of a pair of sole plates which are mounted for relative sliding movement in the shoe. The upper sole plate is pivotally attached at its toe end to an outer sole of the shoe. The lower sole plate of this pair is pivotally mounted with a crank arm which is located at its heel end. Twisted torsion cables are provided to bias the sole plates upwardly against the applied weight of the wearer. A compartment is formed in the shoe between the pair of sole plates and outer sole and is enclosed with a diaphragm to function as a bellows-type air pump to circulate air through the shoe. Preferably, the forced air circulation system is used in which an air bag which overlies the arch of the shoe and with an air pressure hand pump whereby the air pressure within the shoe can be adjustably set to provide the desired degree of tension on the fasteners of the boot.

25 Claims, 11 Drawing Sheets

BOOT WITH FRICTIONAL HEAT GENERATOR AND FORCED AIR CIRCULATION

BACKGROUND OF THE INVENTION

1. Field of Invention

This invention relates to a boot or shoe with a frictional plate heater and forced air circulation and, in particular, to an inner shoe for a ski boot. The invention can be likewise applied to other boots and shoes.

2. Brief Statement of the Prior Art

Ski boots are currently molded with outer shells that entirely surround an inner shoe, also molded of plastic. Recent improvements in this construction have included air bags mounted over the instep with a remote air pump to permit adjustment of the air pressure in the bag and thereby providing adjustment in the tension of the lacing or fasteners of the boot. While this system is suitable for a variable and adjustable tension on the fasteners of the boot, it does not provide for other discomforts. U.S. Pat. No. 4,420,893 discloses an air pump which is operated by the flexing of the ankle during normal skiing actions to circulate fresh air through a ski boot. While this may be useful to reduce the humidity within a boot, it would not be suitable in very cold weather.

In particular, there is no adequate provision in cold weather clothing and shoes to warm one's fingers and toes. As these body extremities are isolated from body heat and are usually protected with limited amounts of insulation, they are particularly susceptible to frostbite. Various mechanisms have been used in attempts to release heat within shoes or boots, and these are described in the following paragraphs. U.S. Pat. No. 3,534,391 discloses an electrical generator which is mounted on the outside of a ski boot which is driven from a tether that is connected between the generator and a ski. The generated current is passed through heating elements located in the ski boot. The external mounting and tether render this device quite cumbersome and difficult to use. French Patent Nos. 701,420 and 2365-973 and U.S. Pat. No. 3,977,093 disclose shoes with batteries mounted in the heels, and with electric resistance heaters in the soles of the shoes. Batteries require frequent replacement, and are particularly inefficient in a cold environment.

U.S. Pat. No. 1,506,282 discloses an electric generator mounted in a telescoping heel of a shoe which generates electricity for an electric lamp, heating coil, wireless outfit or a therapeutic appliance. A telescoping heel of this design would be very difficult to seal against water and mud, and the patented device would most likely be limited to indoor applications.

U.S. Pat. Nos. 2,442,026 and 1,272,931 disclose air pumps which are located in the heels of shoes and operated during walking. In the first mentioned patent, alcohol vapors are mixed with the air stream and passed over a catalyst to generate heat. This system is cumbersome and difficult to use, and it requires replenishing the alcohol. Also, the heater elements are open in the shoe for air and gas circulation. In U.S. Pat. No. 1,272,931, the air is forced through constricted passageways to generate heat by compression. The heated air is openly discharged into the shoe, as there is no provision for a closed loop air path.

U.S. Pat. No. 382,681 discloses an armature which is mounted in a heel and manually rotated to generate heat by friction, which is dissipated in the shoe by metal conductors. U.S. Pat. No. 3,493,986 discloses an inner sole for a shoe which is formed of piezoelectric or magnetostrictive material which generates heat while the user walks.

U.S. Pat. No. 2,475,092 discloses a bouncing skate having spring coils on the bottom of its sole. German Patents Nos. 180,866 and 620,963, and U.K. Patent No. 443,571 disclose springs mounted within a shoe for orthopedic purposes. None of these patents disclose shoe heaters.

U.S. Pat. No. 4,507,877 discloses a heater for a ski boot which is mounted on the inner shoe of the boot and which includes rechargeable storage batteries, control switch and electrical heating coil. Products of this design have been marketed with chargeable and with non-rechargeable batteries. These units do not provide any sustained heating, but are useful only to provide monetary heating because of the limited storage capacity of small batteries and the low efficiencies which they experience at sub-freezing temperatures.

All of the aforementioned attempts have failed to provide a practical self sustaining heater within a shoe which harnesses the movement between the wearer's heel and the heel of the shoe to generate heat. This relative movement can be sufficient, particularly when the wearer's weight is applied, to generate the necessary heat, provided a practical heat generator can be installed within the narrow confines of the shoe and heel, without significantly affecting its external appearance and comfort.

In my prior patent, U.S. Pat. No. 4,674,199, I disclose an electrical generator which is mounted in the heel of a shoe and is driven by the up and down movement of the wearer's heel. The generator is connected to a electrical resistance heater within the shoe. The electrical generator disclosed in my prior patent is effective in warming a shoe, however, often a less complex mechanism is desirable.

BRIEF DESCRIPTION OF THE INVENTION

This invention comprises a frictional heat generator and a forced air circulation system for shoes and, in particular, for boots such as ski boots. The shoe has an inner sole which is formed of a pair of sole plates which are mounted for relative sliding movement in the shoe. For this purpose, the upper sole plate of this pair is pivotally attached at its toe end to an outer sole of the shoe. The lower sole plate of this pair is pivotally mounted with a crank arm which is located at its heel end. Resilient means, preferably in the form of twisted torsion cables are provided to bias the pair of sole plates upwardly against the applied weight of the wearer. The compartment which is formed between the pair of sole plates and outer sole is enclosed with a diaphragm to function as a bellows-type air pump to circulate air through the shoe and, optionally, to other wearing apparel such as an air inflated suit, mittens, etc. Preferably, the forced air circulation system is used in conjunction with an air bag which overlies the arch of the shoe and with an air pressure hand pump whereby the air pressure within the shoe can be adjustably set to provide the desired degree of tension on the fasteners of the boot. When the method is applied to a ski boot, the aforementioned frictional heat generator and forced air circulation mechanism can be formed in the inner shoe which is contained within the outer molded shell of the ski boot or any other boots such as fishing boots, work boots, etc. which are made of heavy rubber or leather.

BRIEF DESCRIPTION OF THE FIGURES

The invention will be described with reference to the FIGURES of which.

DESCRIPTION OF THE PREFERRED EMBODIMENT

Figure 1:
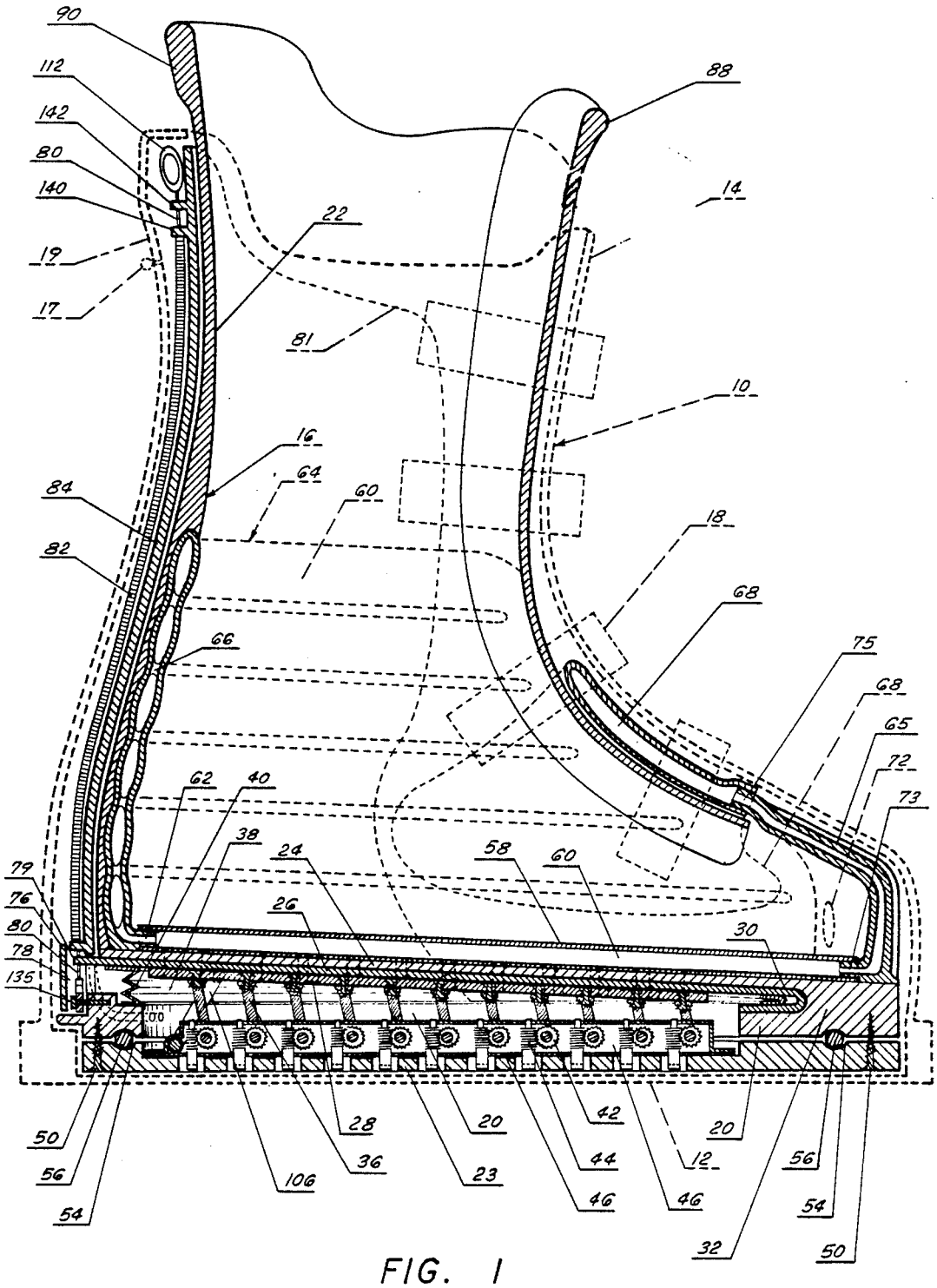
FIG. 1 is an elevational sectional view of a ski boot incorporating an inner shoe with the invention.

The invention is described and illustrated with reference to a ski boot. Although this is the preferred embodiment, the features of the invention can be likewise applied to other boots and shoes. The ski boot has a molded plastic outer shell 10 having an integrally molded sole 12 and upper portion 14. The forward and rear upper portions are typically split and can be spread to open the boot, permitting insertion of the inner shoe 16 and the wearer's foot. These members are retained together by clamps or bindings 18 of various designs.

The inner shoe 16 is received within the outer shell 10 of the boot and generally conforms closely to the inner surfaces of the boot. This inner shoe 16 is also molded of plastics and has an outer sole 20 with upper portions 22 that extend above the ankle and cover the lower portions of the wearer's leg. In accordance with this invention, the inner shoe 16 is provided with an inner sole 24 which is formed by a pair of sole plates, upper sole plate 26 and lower sole plate 28. The upper sole plate 26 is secured to the outer sole of the inner shoe at its toe end 30. This can be provided by integrally molding the inner and outer soles to provide a solid toe portion 32 that connects these two soles. The lower sole plate 28 is formed of a relatively stiff sheet layer and can function as a spring retainer by the attachment of the upper loops of torsion cable springs 36.

The compartment 38 formed between the inner sole 24 and outer sole 20 of the shoe can be enclosed or sealed with a suitable diaphragm 40 that can be corrugated, bellows fashion, as illustrated.

A plurality of springs 36, in the form of torsion cables which are described hereinafter, are provided. These springs are biased between the lowermost sole plate 28 and the outer sole 20 of the shoe to resiliently urge the inner sole 24 upwardly, against the weight of the wearer. Preferably, the torsion on these spring cables is variably adjustable and, for this purpose, each cable has a permanently secured spur gear 42 which is meshed with a worm gear 44 that is supported in the spring housing case 46. The spring housing case 46 is received within the air tight compartment 38 and is supported on the inside upper surface of the outer sole 20.

Preferably, the outer sole 20 has a removable cover 23. For this purpose, the removable cover 23 has a plurality of peripheral apertures which receive fasteners 50 such as screw fasteners that extend into the outer sole 20 of the shoe. Preferably, the mating surfaces of the outer sole 20 and the removable cover 23 of the inner shoe 16 have a peripheral groove 54 which receives a seal 56 such as an elastic O-ring or elastic caulking whereby the interior of the shoe is maintained fluid seal tight.

Preferably, the side walls of the upper portion of the inner shoe 16 are covered with a lining 64. The sole 24 of the inner shoe 16 is also covered with a lining 58. These linings are formed of a sheet material which contains internal tubular passageways 60. This lining 64 entirely covers the internal side walls of the inner shoe 16, and the lining 58 entirely covers the inner sole 24. Preferably the tubular passageways 60 of the sole lining 58 and side wall lining 64 are interconnected to provide open passageways therebetween. This can be provided by a tubular connector 62 between the side wall lining 64 and the sole lining 58 and by interconnecting all of the side lining tubular passageways together, preferably vertically along the heel of the shoe by providing open ports 66 between the tubular passageways. Preferably, the shoe of the invention also has an air bag 68 which overlies the instep area, and has a shape that is generally outlined in the phantom lines of FIG. 1. Tubular passageways 60 of the sole lining 58 and wall lining 64 communicate with a distributor 65 at the toe end of the shoe through connectors 72 and 73 (see also FIG. 2) and the distributor 65 is in open communication with air bag 68 through connectors 75. Preferably at least three such tubular members are provided.

At the heel of the shoe, the inner sole 24 has a rearwardly projecting tab 76 which extends into a brake compartment 78 which is closed with a removable cover plate 79. In this compartment a brake, described in greater detail hereinafter, is provided to lock the inner sole in its compressed position. A brake release cable 80 extends through a flexible conduit 82 mounted on a rear, vertically extending tab 84 of the shoe, and terminates in a pull ring 112. The tab has lateral portions 81 which extend forward, about the wearer's ankles.

Preferably the inside surface of tab 84 and portions 81 have a Teflon coating to provide for ease of sliding movement of these elements. The upper rear portion of the outer boot 10 can be provided as a cover 19 which has a hinge 17 attaching it to the boot 10 so that it can be pivoted open for access to the pull ring 112.

Figure 2:
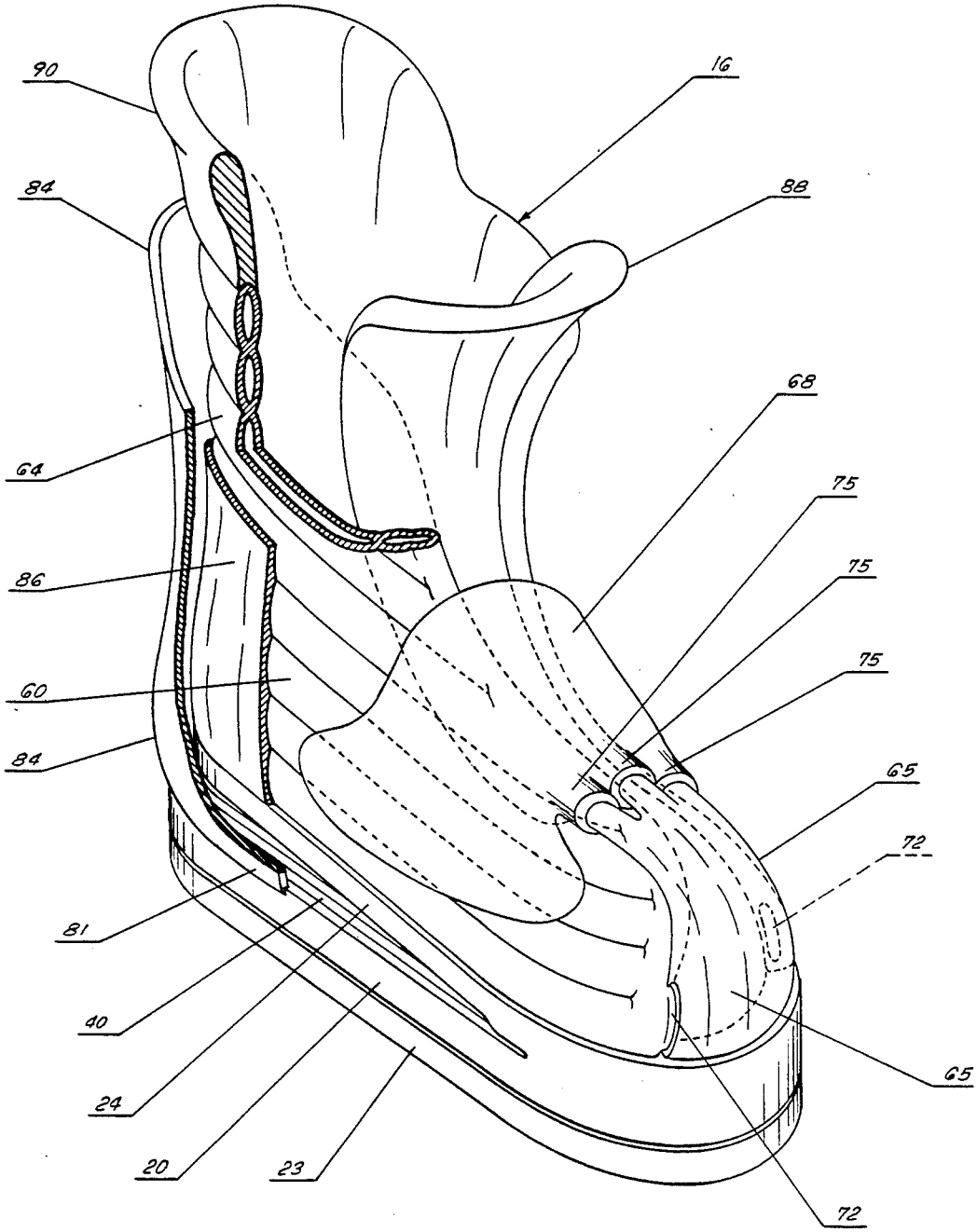
FIG. 2 is a perspective view, partially in cross section of the inner shoe of FIG. 1.

Referring now to FIG. 2, there is depicted a front and top isometric view of the shoe. This illustration shows the shape and position of the air bag 68 which overlies the instep of the shoe. It also shows distributor 65 with connectors 75 and 72 which extend between the air bag 68 and the internal tubular lining 64 and 58 of the shoe. The rear, vertically extending tab 84 is shown partially in sectional view to reveal that the inner shoe also has an insulating outer lining 86. Preferably the insulating outer lining 86 extends substantially the entire vertical height of the upper portion of the inner shoe and the air bag.

The shoe has a conventional tongue 88 and the upper portion 90 of the tubular lining is flared outwardly, in a conventional manner. The diaphragm 40 which encloses the compartment 38 between the inner sole 24 and outer sole 20 of the inner shoe is also illustrated, with fold lines to provide a bellows.

Figure 3:
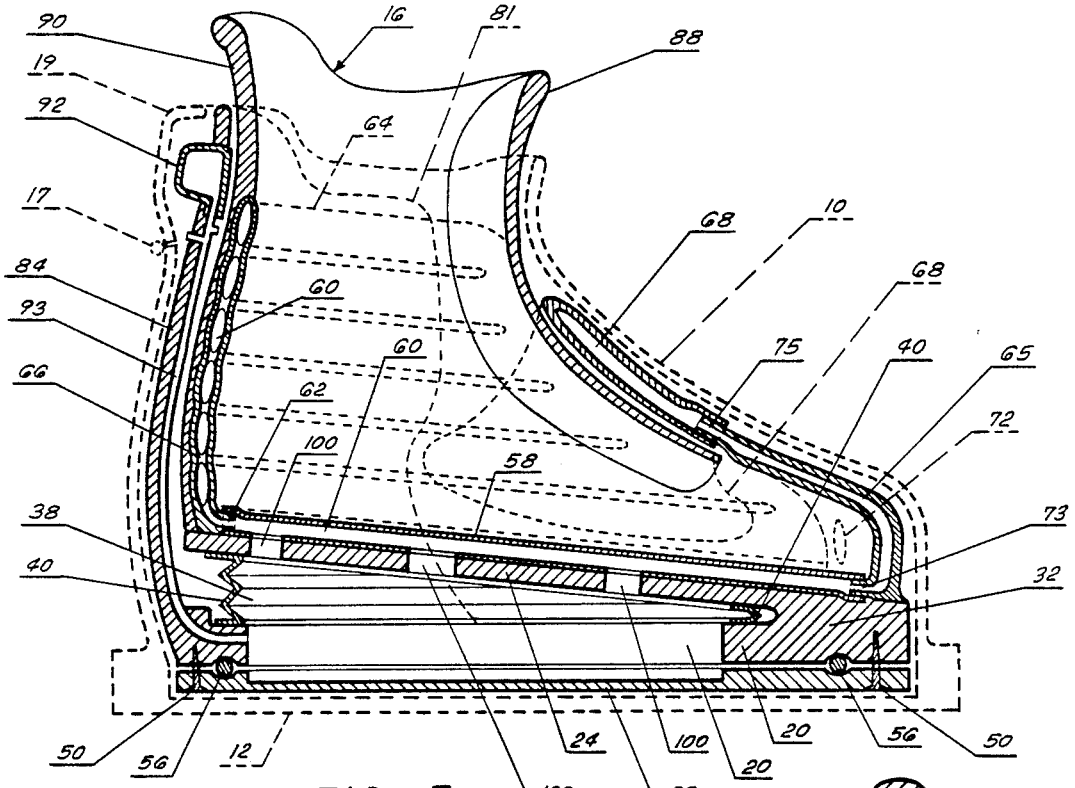
FIGS. 3 and 4 are elevational sectional views to depict the air circulation system of the ski boot with the resilient springs deleted from the illustration.
Figure 4:
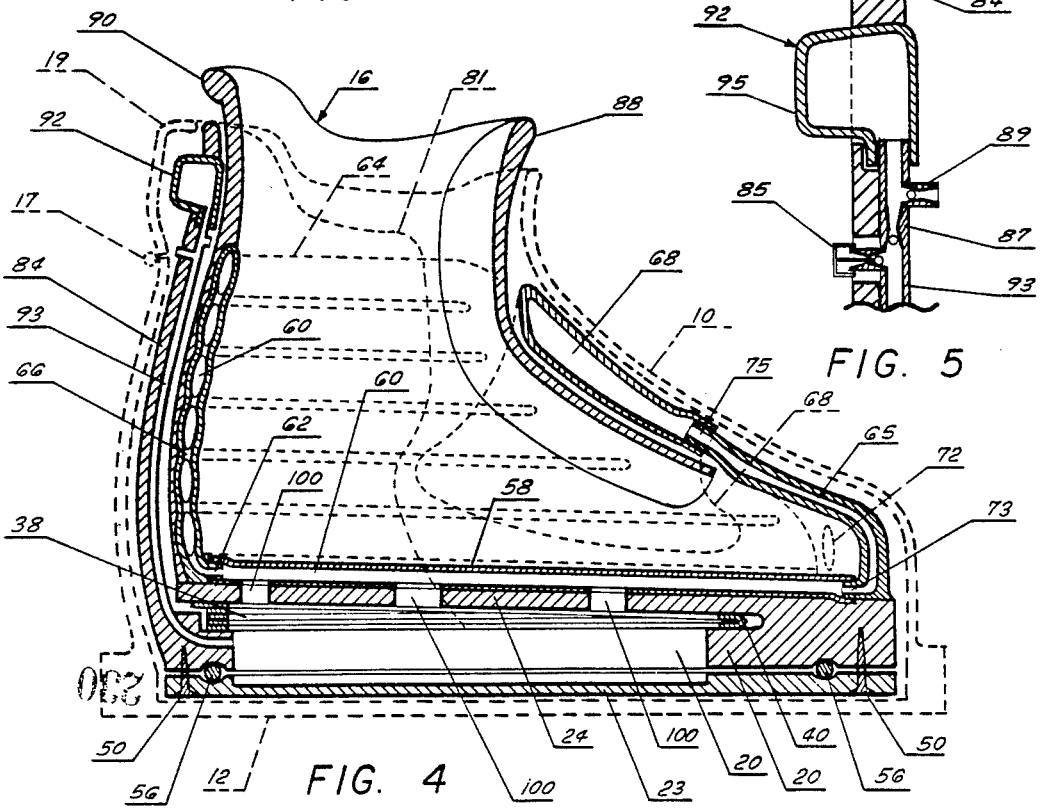

Referring now to FIGS. 3 and 4, the shoe is illustrated in a simplified view to show the function and operation of the air pressurization and circulation system. As previously mentioned, the air bag 68 forms a confined chamber which is in open communication with the lining 64 through the distributor 65 and the tubular connectors 73 and 72. The latter are in open communication with the compartment 38 through openings 100, and with the tubular passageways 60 in the lining 64 on the inside surfaces of the uppers of the shoe, and with the lining 58 on the inner sole 24. An air pump 92 is provided to permit the wearer to adjust the air pressure within the compartment 38, inflatable lining 64 and 58, and air bag 68. The pump applies air though flexible conduit 93 directly into the compartment 38.

The air bag 68 functions to maintain a sense and feeling of tight lacing or binding of the ski boot, while permitting a limited freedom of movement of the inner shoe within the boot. In FIG. 3, the inner sole 24 is shown in its most elevated position. The air bag 68 is compressed in this position, exhausting its air into the compartment 38. When the wearer's weight is applied to the heel, the inner sole 24 moves downwardly, forcing the air from compartment 38 into the air bag 68 (see FIG. 4). Thus, although the instep of the inner shoe 16 moves away from boot 10 during walking and skiing activities, the wearer still senses a tightness of fit, as the air bag 68 maintains pressure on the instep. The normal movement of the wearer's foot within the shoe creates a forced circulation of air through the lining 64 and the compartment 38 which is heated (as described hereafter). This forced circulation increases the heat transfer throughout the shoe.

Figure 5:
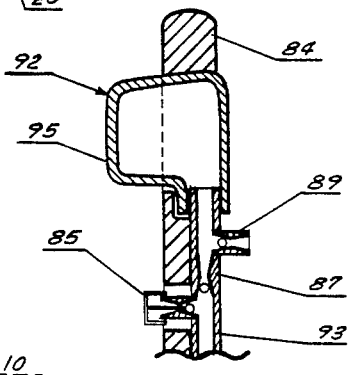
FIG. 5 is an enlarged sectional view of the hand air pump used in the invention.

Referring now to FIG. 5, the air pump 92 comprises a flexible bulb 95. The bulb 95 receives air through the inlet valve 89 and discharges the air under pressure through outlet valve 87. The air system is also provided with a relief valve 85, which when depressed will relieve the air pressure within the air bag system.

Figures 6, 7:
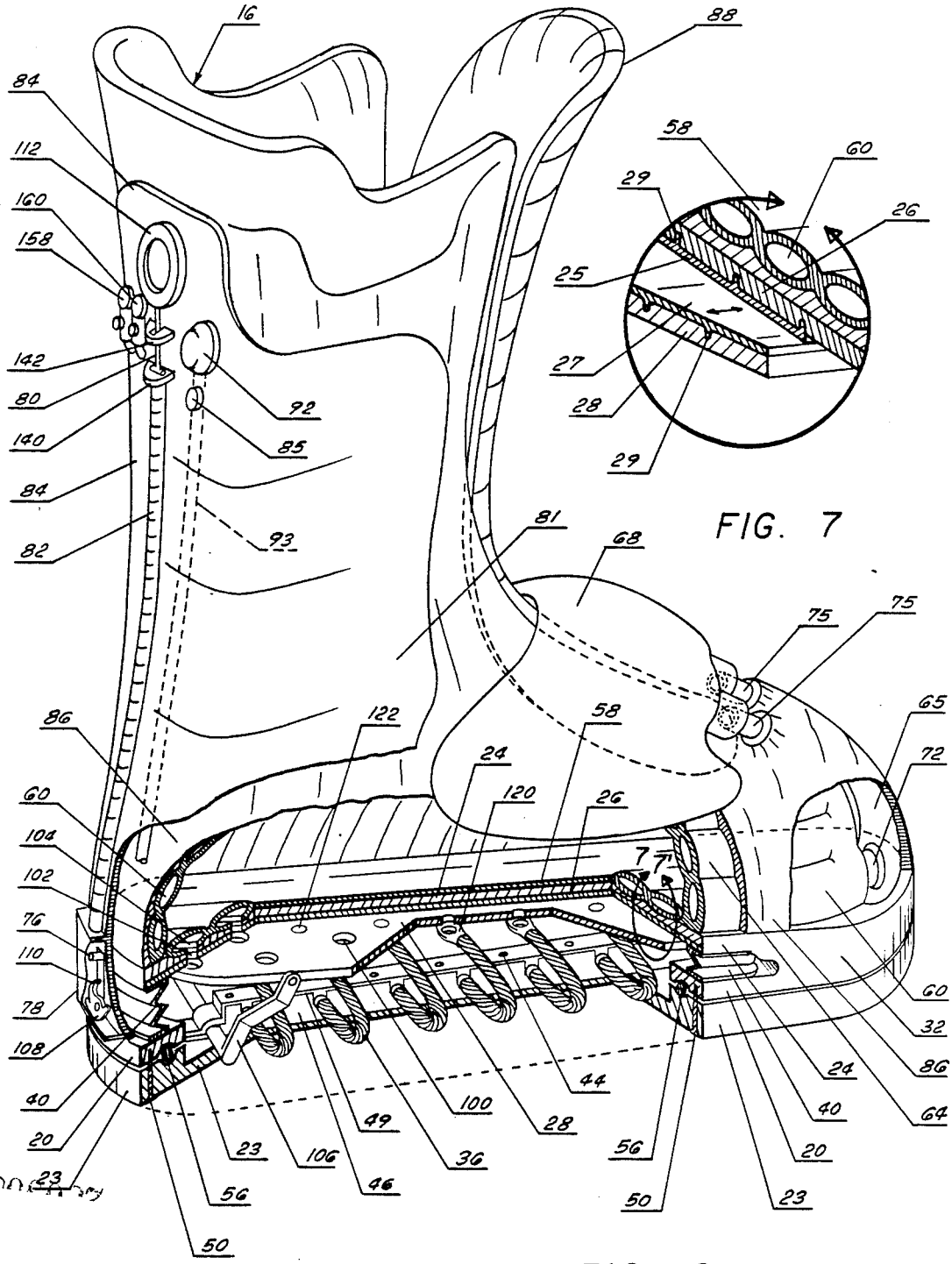
FIG. 6 is a rear perspective view, partially in cross section of the shoe of the invention.
FIG. 7 is an enlarged view of the area within line 7—7' of FIG. 6.

Referring now to FIG. 6, the inner shoe is shown in partial sectional view. A portion of the insulating outer lining 86 of the toe is cut out to illustrate the connector 72 between the forward portion of the tubular inner liner 60 and the distributor 65 which communicates through the connectors 75 with the air bag 68. The lower sole plate 28 which also serves as the spring carrier is foraminous with a plurality of through apertures 100. The apertures 100 are aligned with apertures 102 which extend through the upper sole plate 26 and aligned apertures 104 in the lining 58 and into the tubular channels within this lining, thereby establishing air communication between the enclosed compartment 38 surrounded by the bellows diaphragm 40 and the tubular passageways 60 in the covering 58 on the inner sole of the shoe.

As previously mentioned, the resilient springs 36 for use in the shoe are twisted wire cables that are rigidly secured to the inside surface of the cover 23 and are secured on their opposite sides to the underside of the lower sole plate 28. The lower sole plate 28 is pivotally supported by a crank arm 106 which is generally U-shaped and which is pivotally secured to the opposite sides at the rear or heel end of the cover 23.

As previously mentioned, the brake compartment 78 has a brake mechanism which is the pivotally mounted brake latch 108 that has a hook 110 to secure the tab 78 projecting rearwardly from the heel of the inner sole 24. A cable 80 extends through the flexible conduit 82 to the upper end of the rear vertical tab 84 and a pull ring 112 is attached to the end of the cable 80 permitting the user to engage and disengage the brake as desired. FIG. 6 also illustrates the hand air pump 92 which discharges into a flexible conduit 93 leading into compartment 38 and to the tubular passageways of the inner covering 58 of the shoe to permit adjustment of the air pressure within the tubular linings and the air bag.

FIG. 7 is an enlarged sectional view of a portion of the inner sole showing the upper sole plate 26 and lower sole plate 28. As shown in this view, the opposed surfaces 25 and 27 of these plates are in sliding frictional contact, for as the inner sole is depressed, the lower sole plate 28 is forced downwardly and pivots forward along the arc defined by the crank arm 106, thereby sliding against the undersurface of the upper sole plate 26. The plates can be removable to allow for replacement as necessary to compensate for wear or to change the frictional surfaces. For this purpose, ribs 29 are provided on the plates which snap into receiving grooves 25 and 27 of the supporting plates.

Preferably the opposed surfaces 25 and 27 of these sole plates 26 and 28 bear a roughened, frictional material such as a coating of metal oxides, or organic coatings capable of generating substantial frictional heat when rubbed together. The amount of frictional heat which can be generated with these coatings during normal walking, running or skiing activities is sufficient to warm the wearer's foot. For a simple case of a 150-pound person walking at a moderate pace, e.g., two strides per second with a total heel movement of one inch vertically per stride, the total available work applied to the heel of each shoe would be 150 inch-pounds with each two strides. In the case of a leather upper sole rubbing on a lower metal plate, a typical coefficient of friction will be 0.56, and this can be greatly increased by selection of suitable coatings such as previously mentioned. The force required to cause the leather sole to slide against the metal lower plate would be $150 \times 0.56$ or 83 pounds. This force would be exerted over the relative displacement of the upper and lower soles or over a distance of approximately 0.5 inch. The frictional energy, or work dissipated for this movement would be 41.5 inch-pounds and the power available would thus be 41.5 inch-pounds per second or 3.5 foot-pounds per second. Each foot-pound per second is equivalent to 1.356 watts, and accordingly, the available power would be 4.7 watts. Thus, the total available power applied to the heel of each shoe during a moderately paced walk would be 4.7 watts, all of which would be dissipated or released as thermal energy from the frictional engagement of the two soles. In addition to this frictional heat release from the sliding plates 26 and 28, heat is also generated by the flexing of the wire cable used for the springs 36.

Figure 8:
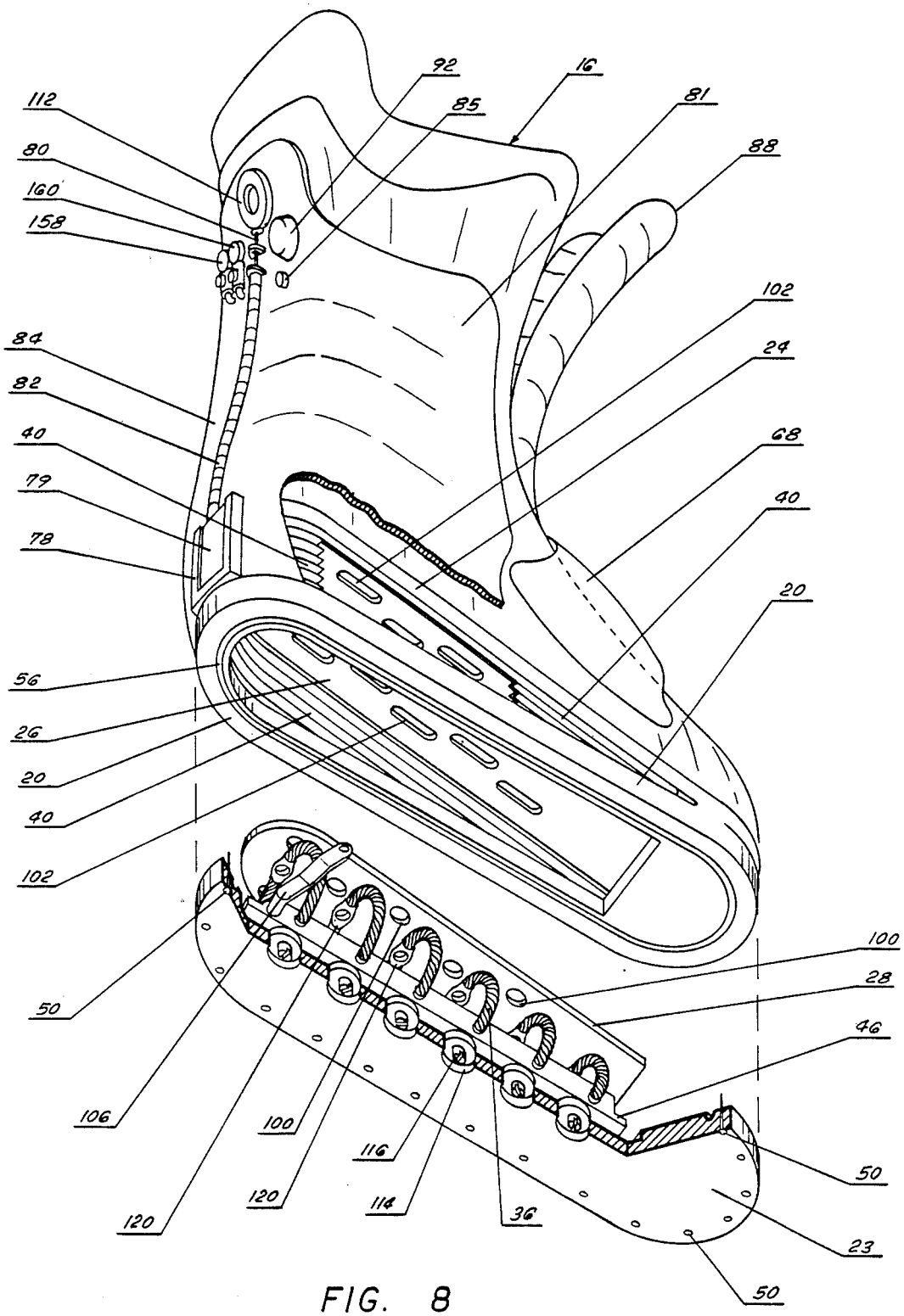
FIG. 8 is a perspective view of the underside of the shoe of the invention partially in exploded view.

Referring now to FIG. 8, the spring mechanism is shown in an exploded view. As there illustrated, the cover 23 of the outer sole 20 of the shoe is removed from the shoe and is sectioned along the row of apertures 114 which receive adjustment screws 116 that have, at their upper ends, the worm gears 44 which engage the spur gears 42 (see FIGS. 1 and 9) to provide variable adjustment of the tension on the torsion cable springs 36. Each of the torsion springs 36 is formed as a loop of the twisted wire cable. As previously mentioned, each of these loops has a permanently attached gear 42 which is meshed with a worm gear 44 that is supported on the end of each adjustment screw 116. The rotation of the adjustment screws 116 applies a preload in torsion to the wire cables, thereby altering their spring response; increasing the torsion will decrease the deflection of the springs for the same loading.

Figure 9:
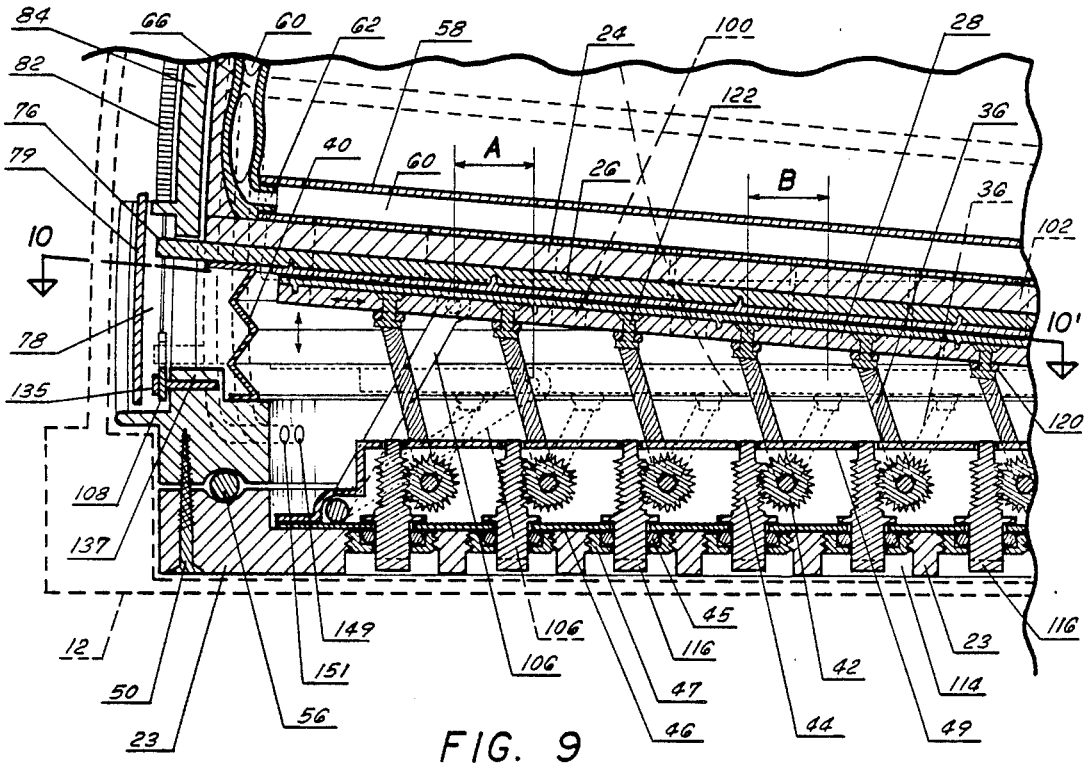
FIG. 9 is an elevational sectional view of the heel area of the shoe of the invention.
Figure 10:
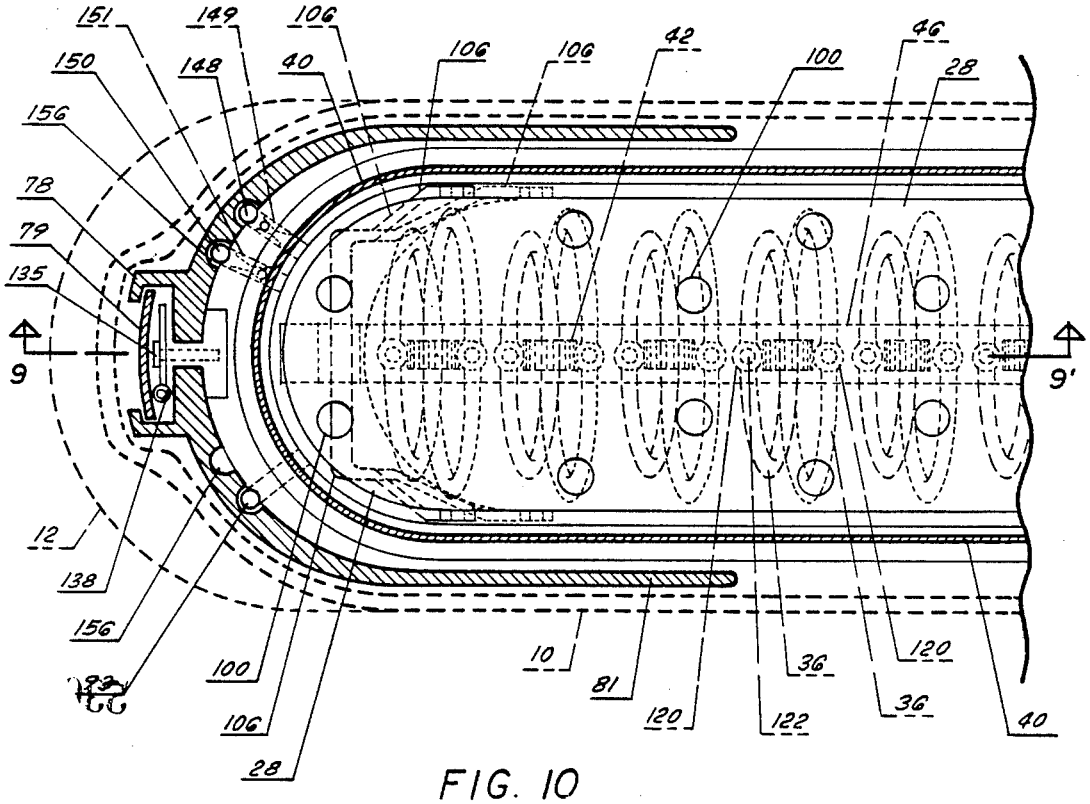
FIG. 10 is a sectional view along line 10—10' of FIG. 9.

Preferably a plurality of torsion springs 36 is provided, spaced in equal incremental positions along the length of the soles of the shoe. FIG. 8 also illustrates the elongated slots 102 in the inner sole 24 which provide the communication to the air channels or tubular passages within the tubular covering 58. Referring now to FIGS. 9 and 10, the resilient torsion springs 36 will be described in greater detail. As there illustrated, the torsion springs 36 are resiliently biased against the underside of the lower sole plate 28. This plate is pivotally mounted to the base of the outer sole 20 by the crank arm 106, previously described. The plate 28 and springs 36 are shown in their extended or most upright position in solid lines and in the depressed or contracted positions in the phantom lines of FIG. 9. Each of the torsion springs 36 has an eyelet 120 centrally located along its upper extremity and each eyelet 120 receives a rivet 122 or other fastener that firmly secures the torsion spring to the sliding lower plate 28. The loops of the springs 36 are shown in FIG. 10 in phantom lines in both the upright and the depressed conditions. As illustrated in FIG. 9, a gear 42 is permanently attached to each loop of the springs 36 and this gear is meshed with a worm gear 44 that is supported on the end of each adjustment screw 116. The assembly of gears and worms gears is mounted within a housing case 46 with a cover 49 which has apertures in which the adjustment screws 116 are mounted. Preferably each adjustment screw 116 is surrounded by a seal ring 45 which is retained by a threaded plug 47. As previously mentioned rotation of the adjustment screws 116 applies a preload in torsion to the wire cables, thereby altering their spring response.

The forward component of the arc movement of the crank arm 106 during up and down movements is shown as A on FIG. 9. The distance of the sliding motion between plates 26 and 28 is shown as B on FIG. 9. The distances A and B are equal. This sliding movement of the plates generates frictional heat. The spring 36 will twist through an angle twice the included angle between its up position (solid lines) and down position (dashed lines). Additionally, it will flex to a different configuration as shown by the sets of spring configurations shown in dashed lines in FIG. 10. All this twisting and flexing will also generate heat.

Figure 11:
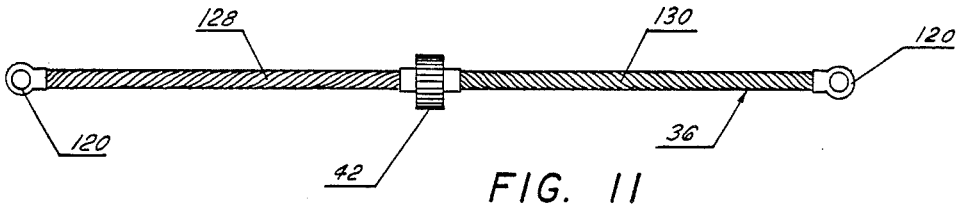
FIGS. 11–14 are illustrations of the torsion cable springs used in the invention.

Referring now to FIGS. 11 through 14, the torsion springs 36 will be described. A typical torsion spring 36 is shown in FIG. 11 as including a central spur gear 42 which is permanently attached to the middle of the cable 36. Each of the ends 128 and 130 of cable 36 is wound in a reverse direction, as indicated by the direction of the lines of the individual wires within these cables. The opposite ends of the cables are permanently attached to an eyelet 120.

Figure 12:
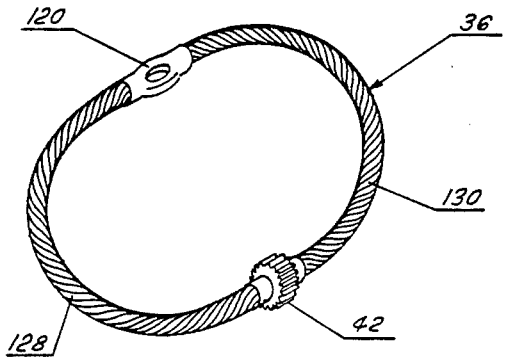

The aforementioned torsion cable assembly is assembled into a loop by interconnecting the two eyelets as illustrated in FIG. 12. Each of the resulting torsion springs 36 can then be secured independently in the previously discussed assembly.

Figure 13:
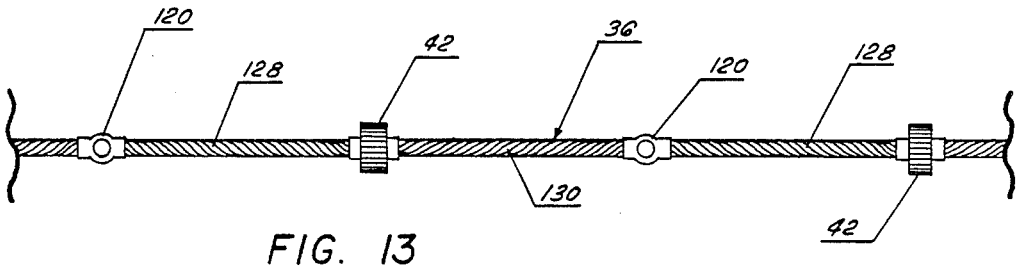
Figure 14:
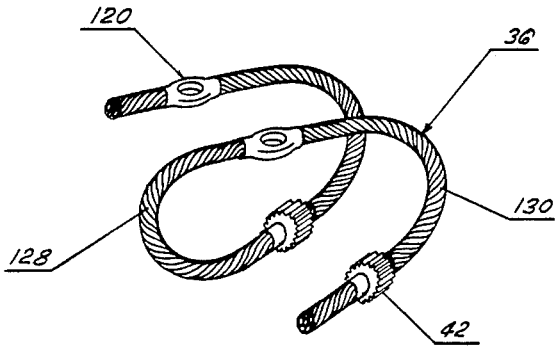
Figure 15:
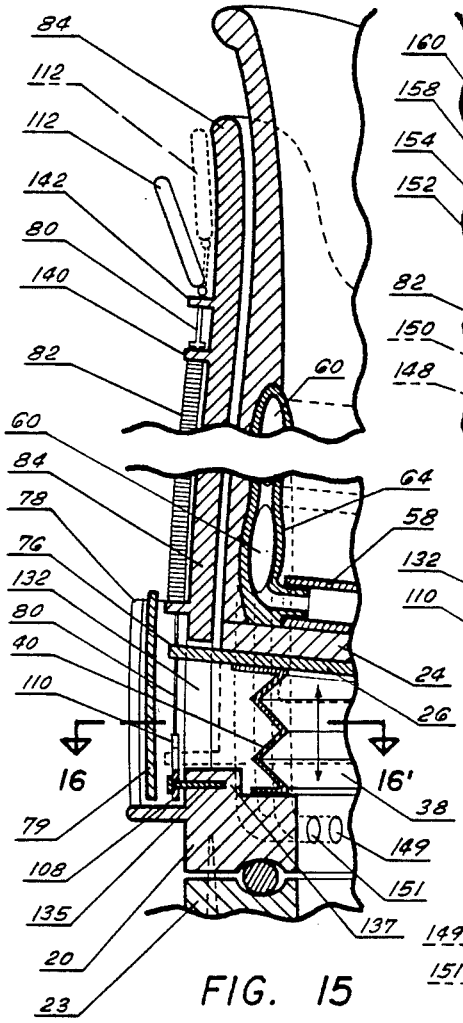
FIG. 15 is an elevational sectional view of the heel along lines 15—15' of FIG. 16.
Figure 17:
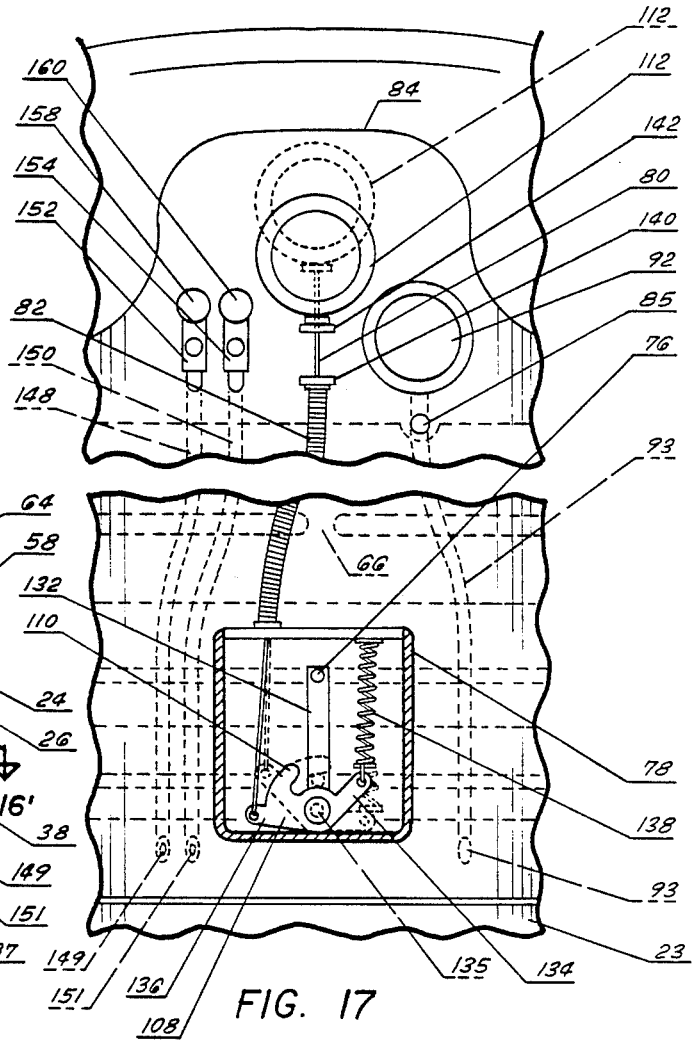
FIG. 17 is a view along lines 17—17' of FIG. 16.
Figure 16:
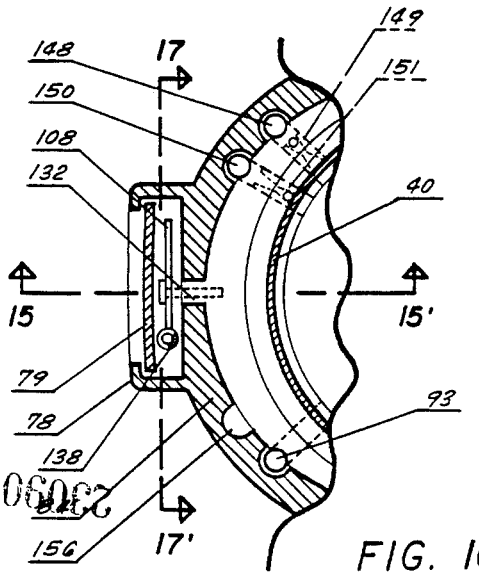
FIG. 16 is a sectional view along lines 16—16' of FIG. 15.

Alternatively, the cables can be interconnected longitudinally in the manner illustrated in FIG. 13. In this construction, the eyelets 120 and spur gears 42 are alternately connected to adjacent torsion cables 128 and 130, forming a continuous string. The resulting continuous torsion cable can then be formed into loops in a continuous helical manner as illustrated in FIG. 14.

Referring now to FIGS. 15 through 18, the brake mechanism will be described in greater detail. As previously described, the outer sole 20 supports, at its heel end, the vertical tab 84 which has a vertical slot 132 to receive the projecting tab 76 at the heel end of the inner sole 24. The length of this vertical slot 132 provides the limits of vertical travel for the heel end of the inner sole 24. The brake mechanism includes a latch 108 that is pivotally secured by screw 135 which is received in block 137. The latch 108 has a latch hook 110 to lock onto the projecting tab 76 on the heel of the inner sole 24. Latch 108 has a spring arm 134 and an actuator arm 136 with a latching hook 110. A spring 138 resiliently biases the latch into an unlatched position, which is shown by the solid lines in FIG. 17. When the release cable 80 is pulled upwardly, the latch hook 110 is rotated into engagement with projecting tab 76, thereby locking the projecting tab 76 and its dependent inner sole 24 in the depressed position, all as shown by the phantom lines in FIGS. 15 and 17.

Figure 18:
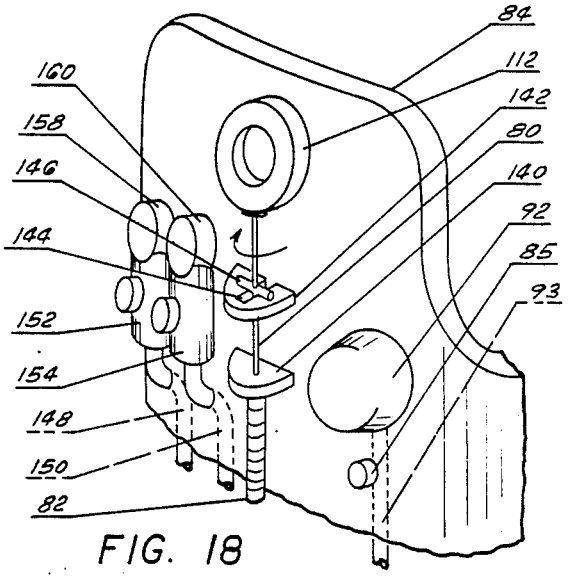
FIG. 18 is a perspective view of a tab at the upper rear of the shoe of the invention.

As shown in FIG. 18, the release cable 80 extends upwardly through a mounting bracket 140 and a locking bracket 142 which has a single elongated slot 144. A pin 146 is transversely permanently secured to the release cable 80 so that when it is pulled through the slot 144 and rotated, as shown in FIG. 18, it will lock the release cable 80 against retraction, thereby securing the latch hook 110 in its detenting position against the bias of the spring 138.

As previously mentioned, the shoe can also be used to pump warm air from the compartment 38 to an inflated suit, or to a suit lined with an inflated lining similar to lining 58. For this purpose, flexible conduits 148 and 150 (see FIG. 17) are provided. These conduits are provided with shutoff valves 152 and 154 so that conduit 148 supplies air from the shoe to the suit, and conduit 150 returns air from the suit to the shoe. The conduits extend along channels 156 on the inside surface of tab 84 (see FIG. 16) and exit at the top of the tab 84, terminating in conduit connectors 158 and 160.

Figure 19:
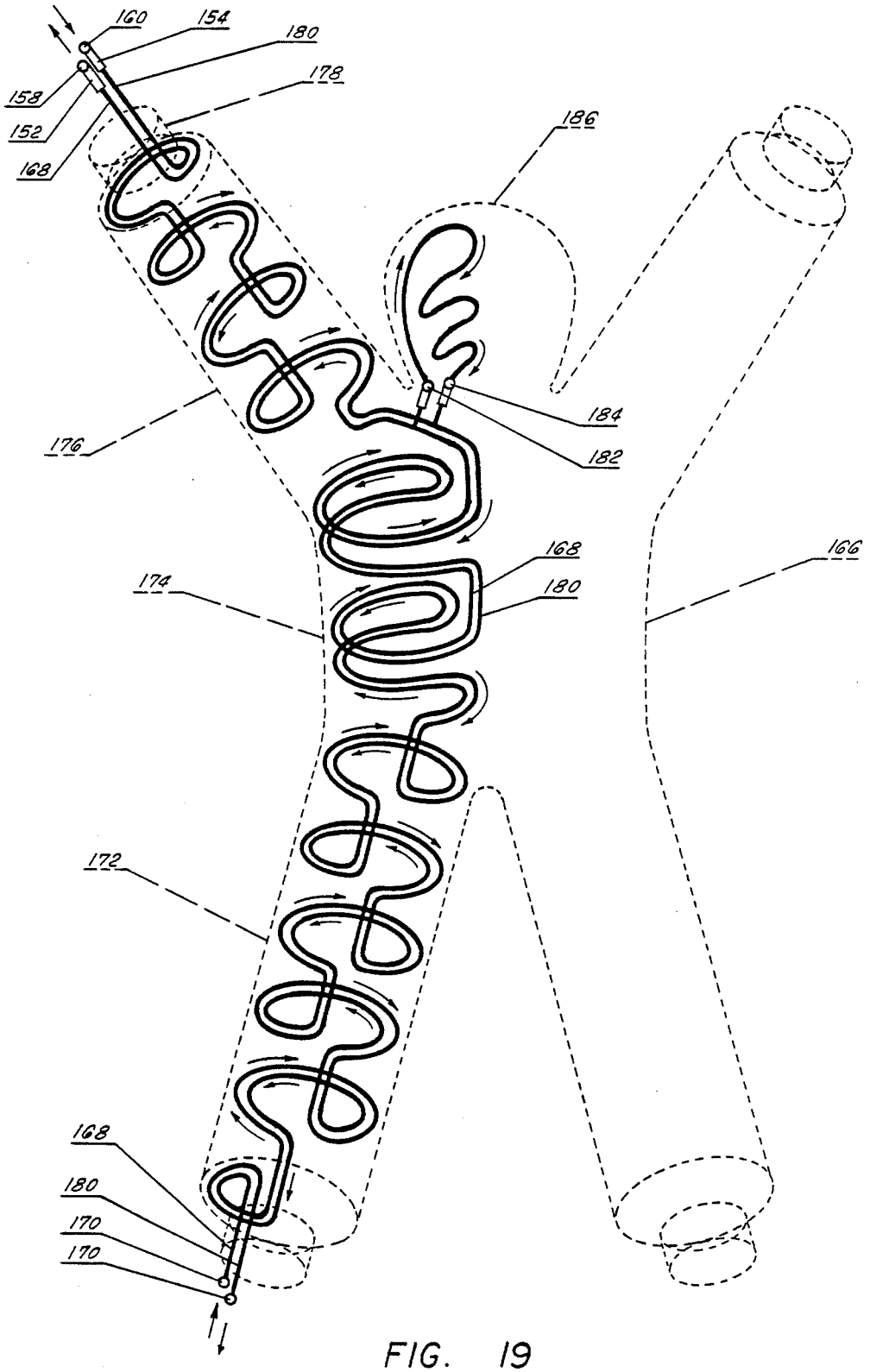
FIG. 19 is an illustration of the arrangement of tubular air passageways in a suit which can be worn by a skier.

As previously mentioned, a suit with air passageways can be used with the shoes of the invention. For this purpose, a suit 166 such as illustrated in FIG. 19 can be employed. The suit 166 can have a continuous serpentine flexible conduit 168, typically formed of extruded plastic, which extends from an inlet connector 170 at the lower cuff of a leg 172 of the suit 166, extending along the leg and body portion 174 and the arm 176 of the suit 166. At the wrist cuff 178, the flexible conduit can be joined to a second, generally parallel conduit 180 for returning cooled air to the shoe. If desired, branch connectors 182 and 184 can be provided adjacent the neck area of the suit 166 to permit passing of the warm air through the helmet or cap 186 of the wearer and returning this to the cool line return conduit 180.

Figure 21:
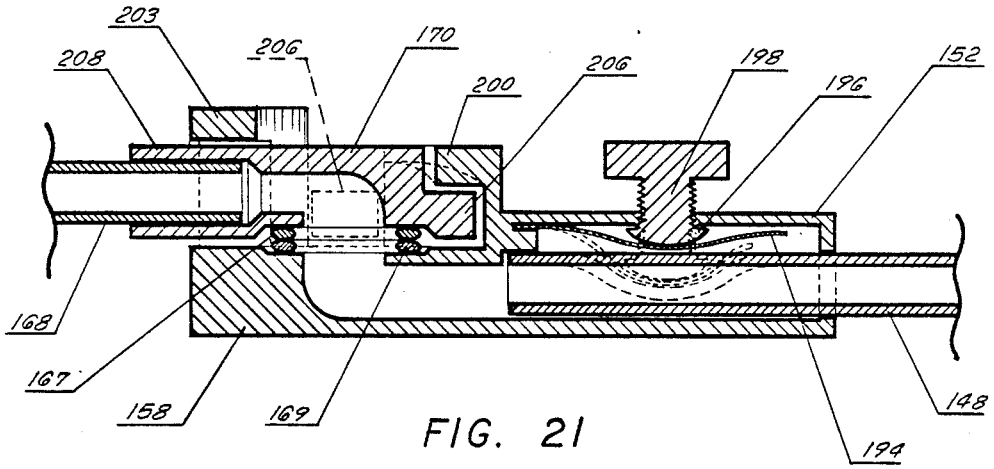
FIG. 21 is a view along lines 21—21' of FIG. 20.
Figure 20:
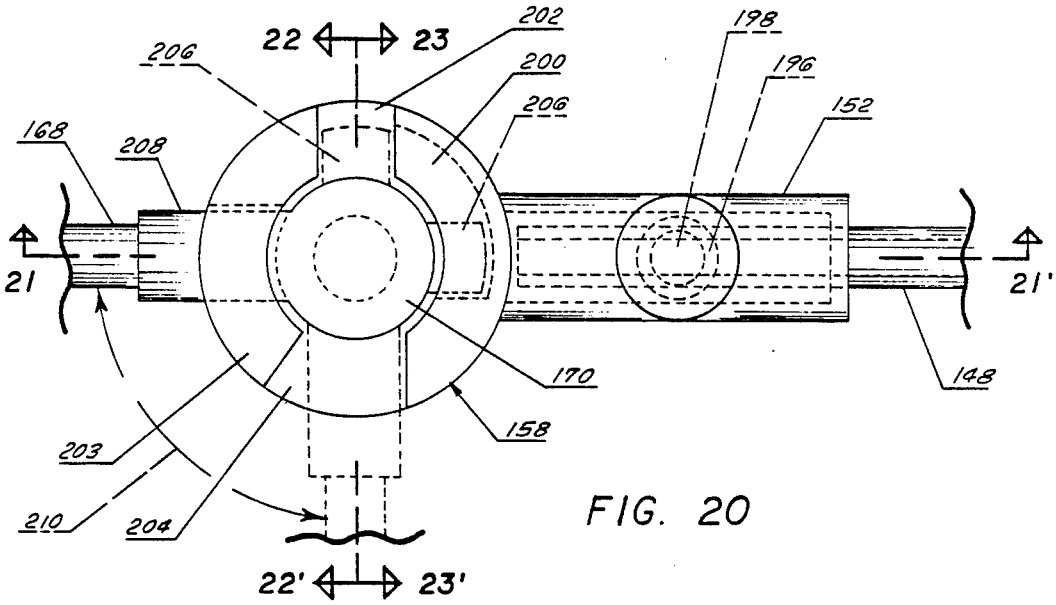
FIG. 20 is a view of a suitable valve and connector used to connect the air passages of the boot to external elements such as the suit of FIG. 19.
Figure 22:
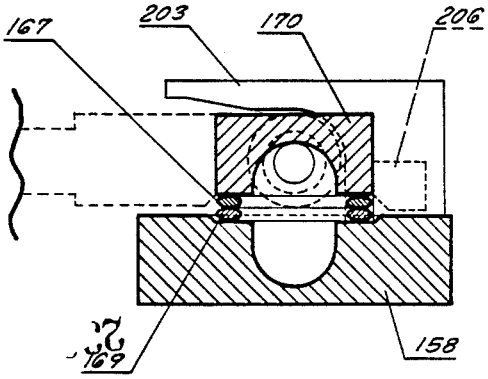
FIG. 22 is a view along lines 22—22' of FIG. 20.
Figure 23:
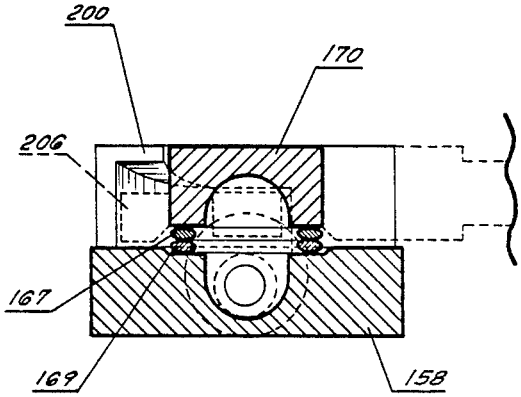
FIG. 23 is a view along lines 23—23' of FIG. 20.

Referring now to FIGS. 20 through 23, there is depicted the preferred connectors 158 and 160 for attachment of the air passage conduits 148 and 150 of the boot to the conduits 168 and 180 of the wearing apparel. FIG. 20 is a plan view of the typical assembly connector 158 and shutoff valve 152. As shown in FIG. 21, the connector 158 is provided with a flow control or shutoff valve 152 having a flexible valve operator 194 that can be depressed by rotating a thumb wheel 196 carried on the end of a threaded post 198. This connector 158 has an annular rim 200 and a second annular rim 203 which are separated by radial slots 202 and 204 to permit reception of the connector 170. This connector has a radial tab 206 which is received beneath annular rim 200 (see FIGS. 20 and 21), and a connector sleeve 208 which is received beneath annular rim 203. The connectors 158 and 170 are sealed together with compressible seal rings 167 and 169. The connector sleeve 208 receives the end of flexible conduit 168 of the suit 166. The connectors 158 and 170 are secured together by placing the connector 170 in the position indicated by the phantom lines of FIGS. 22–23. The connector 170 is then rotated as shown by the arrowhead arc 210 of FIG. 20.

Figure 24:
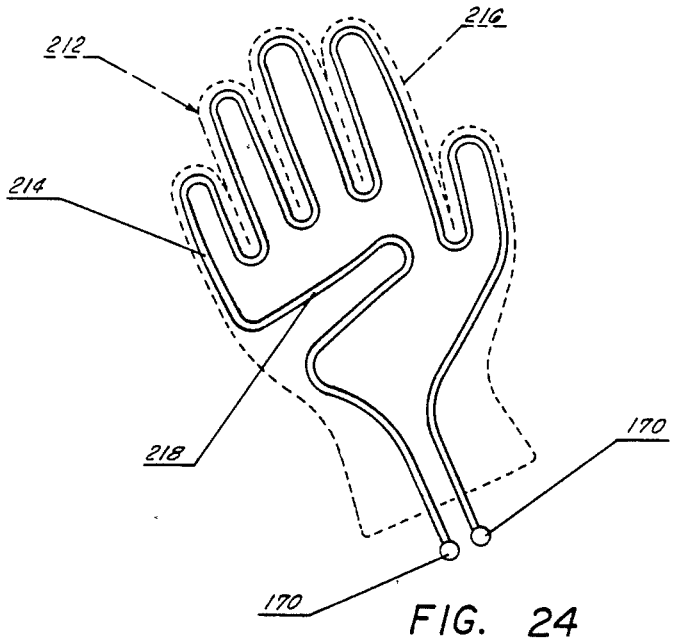
FIG. 24 illustrates an air passageway arranged in a glove or a mitten which can be worn by a skier.

Referring now to FIG. 24, there is illustrated a glove or mitten 212 which can be used with the suit 166 shown in FIG. 19. The outline of this glove 212 is shown in its outline in the phantom lines of FIG. 24. It has an internal, continuous tubular passageway that can be formed by suitable flexible tubing 214. The tubing preferably runs along each of the fingers 216 and has a branch 218 that extends across the palm of the glove. This glove is attached with connectors 170 to the ends of conduits 168 and 180 of the suit shown in FIG. 19 to permit heated air to be passed through this glove and returned to the suit.

Figure 25:
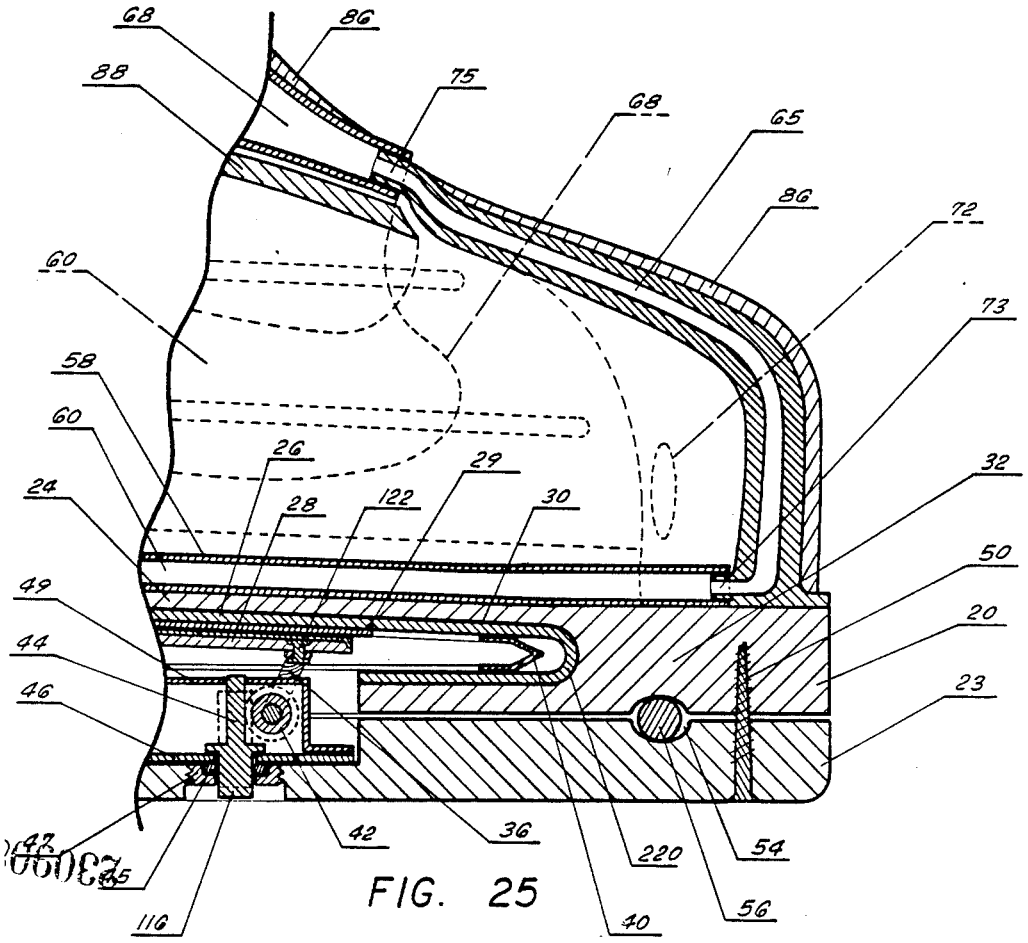
FIG. 25 is an elevational sectional view of the toe of the shoe of the invention.

FIG. 25 is a detailed sectional view of the toe end of the inner shoe. The spring carrier plate 28 is resiliently biased against the underside of the sole plate 26. This sole plate 26 is preferably formed with a reverse bend 220 at its toe end 30.

The invention has been described with reference to the illustrated and presently preferred embodiment. It is not intended that the invention be unduly limited by this disclosure of the presently preferred embodiment. Instead, it is intended that the invention be defined, by the means, and their obvious equivalents, set forth in the following claims:

I claim:

1. A boot having an internal, sealed air system with forced air circulation which comprises:

a. a sole formed of an outer sole and an inner sole pivotally attached together at the toe of the boot for hinged movement in response to the movements of a wearer's foot;

b. a first compartment between said outer and inner soles;

c. a flexible diaphragm extending between said inner and outer soles, enclosing and sealing said first compartment;

d. at least a second compartment located within said boot and above the inner sole thereof;

e. an air passageway means open to said first and second compartments and extending therebetween to permit free air flow between said compartments; and f. a frictional heat generator mounted in said first compartment for movement in response to said hinged movement of said inner and outer soles, thereby providing a frictional heat generator located within said first compartment.

2. The boot of claim 1 including an outer shell receiving an inner shoe which includes said outer and inner soles.

3. The boot of claim 1 wherein said shoe has an inside lining continuous with its upper portions which is formed of a layer having internal and interconnecting tubular cavities, with said air passageway means defined by a tubular connector communicating between said first compartment and said tubular cavities.

4. The boot of claim 1 wherein said inner sole is covered with a lining formed of a layer having internal and interconnecting tubular cavities and including air passages open between said first compartment and said tubular cavities.

5. The boot of claim 2 wherein said inner shoe has a sole which is formed with a central plate having an open recess at its heel and instep region and a continuous bottom plate which is sealingly secured on the bottom thereof.

6. The boot of claim 5 wherein said bottom plate is removably secured to said central plate and including a resilient seal member captured between said central and bottom plates, entirely surrounding and sealing said recess.

7. The boot of claim 2 wherein said second compartment is an air bag which is positioned above the instep of the wearer's foot and between the inner shoe and shell.

8. The boot of claim 1 including an air pump with an inlet port open to receive fresh air and a discharge port open to fluid passageway means communicating with said compartment and air bag, whereby the pressure of air within said compartment and air bag can be adjustably controlled.

9. The boot of claim 8 wherein said air pump comprises a chamber having at least one collapsible wall with button means engaging said collapsible wall, and with check valve means in said inlet and discharge ports to induce air circulation.

10. The boot of claim 1 including resilient means positioned within said first compartment and biased against the underside of said inner sole to urge said inner sole upwardly, against the applied weight of the wearer.

11. The boot of claim 10 wherein said resilient means comprises a torsion cable formed of a plurality of twisted resilient wires preloaded with a predetermined degree of torsion and looped between the underside of said inner sole and said bottom plate.

12. The boot of claim 11 including a plurality of loops of said torsion cable positioned between said inner sole and said bottom plate.

13. The boot of claim 11 including spring adjustment means to apply rotational torsional stress to said torsion cable, thereby providing a controllable degree of resiliency to said cable.

14. The boot of claim 12 wherein said loops of said torsion cable are secured to a support frame mounted on said bottom plate and including a drive gear permanently secured to each loop of said cable, with means to rotate each of said drive gears and thereby provide a predetermined degree of torsional loading on said loops of torsion cable.

15. The boot of claim 14 wherein said means to rotate each of said drive gears comprises a worm gear rotatably mounted on said support frame.

16. The boot of claim 12 wherein said plurality of loops are discontinuous.

17. The boot of claim 1 including a tubular air passageway supported on the upper of said boot and communicating with a tubular connector for the removable attachment of a tubing connector externally of said boot.

18. The combination of the boot of claim 17 and wearing apparel having at least a lining which includes at least one tubular passageway with a terminal connector thereof in engagement with said tubular connector communicating with the sealed internal air system of said boot.

19. The combination of claim 18 wherein said wearing apparel includes a suit having legs and arms to receive the legs and arms of a wearer.

20. The combination of claim 18 wherein said wearing apparel includes hand coverings with linings having tubular sealed passageways with connector means to communicate with said connector.

21. The boot of claim 10 including brake means engageable to lock said inner sole in a depressed position.

22. The boot of claim 21 wherein said brake means is located in a brake chamber in the heel of said boot and includes a remote release cable extending from said brake chamber to the top portion of said boot.

23. The boot of claim 22 wherein said boot has a vertical tab at its heel end and said remote release cable extends to the upper end of said vertical tab.

24. The boot of claim 1 wherein said inner sole has an upper and a lower sole plate which are in mutual sliding frictional contact, thereby providing said frictional heat generator.

25. The boot of claim 11 wherein said torsion cable resilient means flexes and also generates frictional heat during flexing.

* * * * *